United States Patent [19]

Azulai et al.

[11] Patent Number: 4,467,694

[45] Date of Patent: Aug. 28, 1984

[54] MINE FIELD CLEARING APPARATUS

[75] Inventors: Max Azulai, Beersheva; Simcha Bar-Nefy, Omer; Michael Tiomkin, Beersheva, all of Israel

[73] Assignee: Israel Aircraft Industries, Ltd., Lod, Israel

[21] Appl. No.: 383,214

[22] Filed: May 28, 1982

[30] Foreign Application Priority Data

Jul. 27, 1981 [IL] Israel ..... 63437

[51] Int. Cl.[3] ..... F41H 11/2

[52] U.S. Cl. ..... 89/1 M; 171/141; 89/36 H; 37/2 R; 172/828

[58] Field of Search ..... 37/274, 275, 2 R; 89/1 M; 171/1, 2, 3, 23, 44, 46, 47, 50, 81, 139, 141, 142; 414/680; 172/777, 766, 828, 829, 815, 701

[56] References Cited

U.S. PATENT DOCUMENTS

| | | | |
|---|---|---|---|
| 1,423,887 | 7/1922 | Stewart | 414/443 X |
| 2,322,115 | 6/1943 | Cox | 172/766 X |
| 2,388,015 | 10/1945 | Shoemaker | 414/443 |
| 2,425,357 | 8/1947 | Walker | 89/1 M |
| 2,460,322 | 2/1949 | Walker | 89/1 M |
| 2,486,372 | 10/1949 | Rockwell | 172/777 |
| 2,489,349 | 11/1949 | White | 89/1 M |
| 3,771,413 | 11/1973 | Sieg | 89/1 M |
| 4,384,620 | 5/1983 | Uchida | 172/815 |

FOREIGN PATENT DOCUMENTS 914285 6/1946 France .

OTHER PUBLICATIONS

Jane's Combat Support Equipment, 1st Ed. 1978–1979. Ed Christopher F. Foss, MacDonald & Jones Publishers Ltd., London 1978, p. 1978.

Minenraum-Anbaugerat KMT-5, Soldat and Technik 4/1976, pp. 176–178.

*Primary Examiner*—Richard J. Johnson

*Attorney, Agent, or Firm*—Cushman, Darby & Cushman

[57] ABSTRACT

Mine clearing apparatus for attachment to a vehicle comprising a frame mountable onto a vehicle for selectable positioning in a raised or lowered orientation; apparatus for raising and shunting aside mines mounted onto the frame; and apparatus for selectably retaining the frame in a raised orientation and comprising control apparatus operable from inside the vehicle for releasing the frame from the raised orientation and allowing it to assume the lowered orientation.

6 Claims, 5 Drawing Figures

MINE FIELD CLEARING APPARATUS

FIELD OF THE INVENTION

The present invention relates to apparatus for clearing mines, and more particularly to mine clearing apparatus mountable on an armoured vehicle such as a tank.

BACKGROUND OF THE INVENTION

It is known in tank warfare to employ mine clearing apparatus mounted on a vehicle for clearing a path through a mine-field. Conventional mine clearing apparatus which is mounted on armoured vehicles is relatively cumbersome and often interferes with the fighting ability of the tank. This is due to a number of disadvantages. Firstly, once it is desired to pass through a mine field, lowering the mine clearing apparatus into ground engaging position requires a manual operation from outside the tank. Raising of the mine clearing apparatus out of ground engaging position is sometimes done manually and sometimes done by means of a hydraulic lifter. The hydraulic lifter is extremely susceptible to failure and may be readily disabled even by small-weapons fire. In such a case the tank may be totally disabled in its mobility. Another difficulty with conventional mine clearing apparatus is that in its raised position, it interferes with the field of vision of the driver of the vehicle and may also interfere with the positioning of the cannon of an armoured vehicle, such as a tank.

SUMMARY OF THE INVENTION

The present invention seeks to overcome disadvantages and limitations of prior art mine clearing apparatus and provides mine clearing apparatus for attachment to a vehicle comprising a frame mountable onto a vehicle for selectable positioning in a raised or lowered orientation; apparatus for raising and shunting aside mines mounted onto the frame; and apparatus for selectably retaining the frame in a raised orientation and comprising control apparatus operable from inside the vehicle for releasing the frame from the raised orientation and allowing it to assume the lowered orientation.

Further in accordance with an embodiment of the invention, there is provided mine clearing apparatus for attachment to a vehicle comprising a frame mountable onto a vehicle for selectable positioning in a raised or lowered orientation; apparatus for raising and shunting aside mines mounted onto the frame; and apparatus for automatically raising the frame from its lowered orientation to its raised orientation in response to backwards motion of the vehicle.

Additionally in accordance with an embodiment of the invention, the apparatus for raising and shunting aside mines comprises a plurality of plow teeth which, in operation, extend below the ground surface and first and second plow sections, disposed one above another in hinged engagement and operative to lie in the same plane during operation and in folded engagement when the frame is in its raised orientation, so as not to interfere with normal tank operation.

Further in accordance with an embodiment of the present invention, the raising and shunting apparatus also comprises a gliding surface which supports the frame in its lowered orientation. The gliding surface is provided with a front mine deflector plate for deflecting mines in the path thereof. The gliding surface may be provided with a retaining member so as to prevent inadvertent engagement of the gliding surface with treads of its supporting vehicle under certain conditions of terrain.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1:
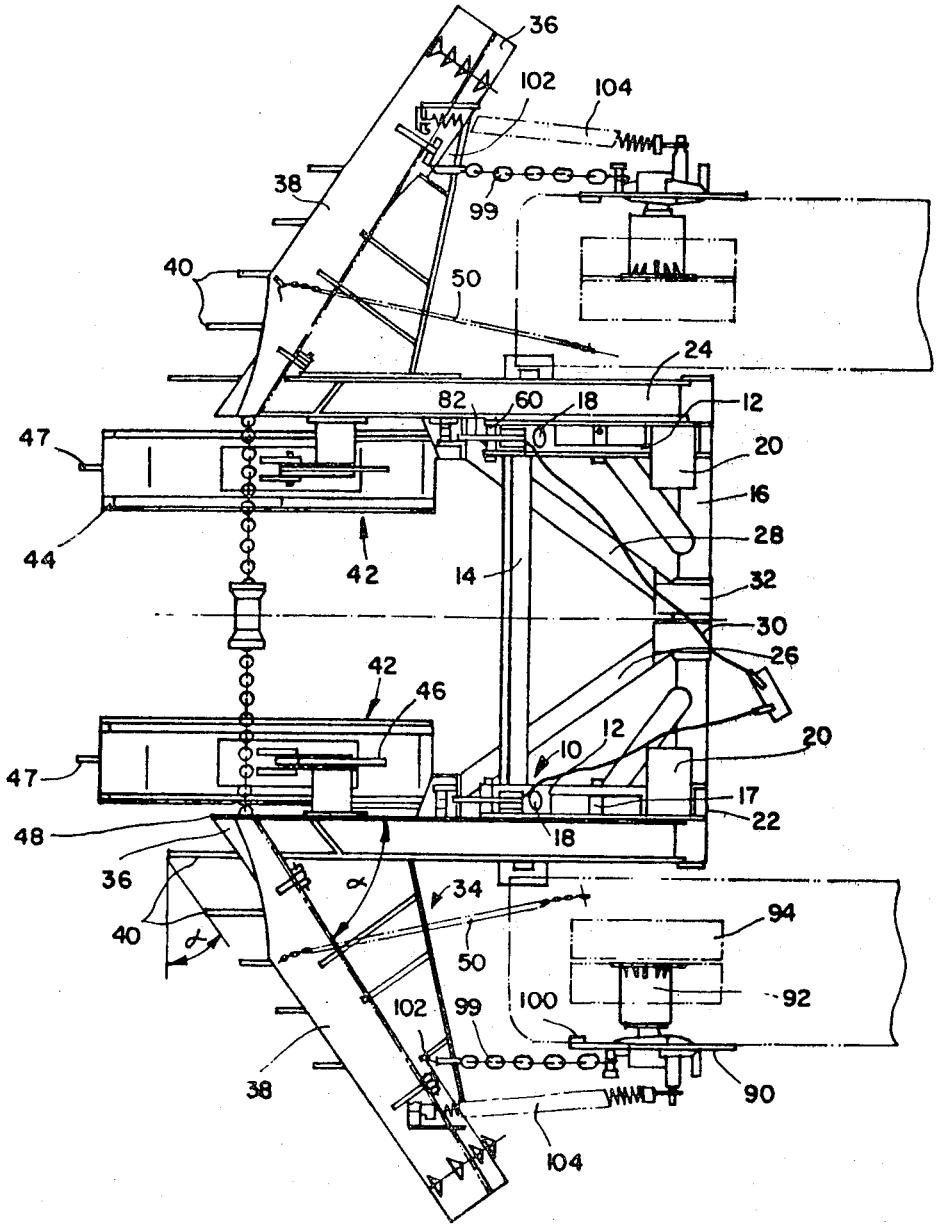
FIG. 1 is a top view illustration of mine clearing apparatus constructed and operative in accordance with an embodiment of the present invention.
Figure 2:
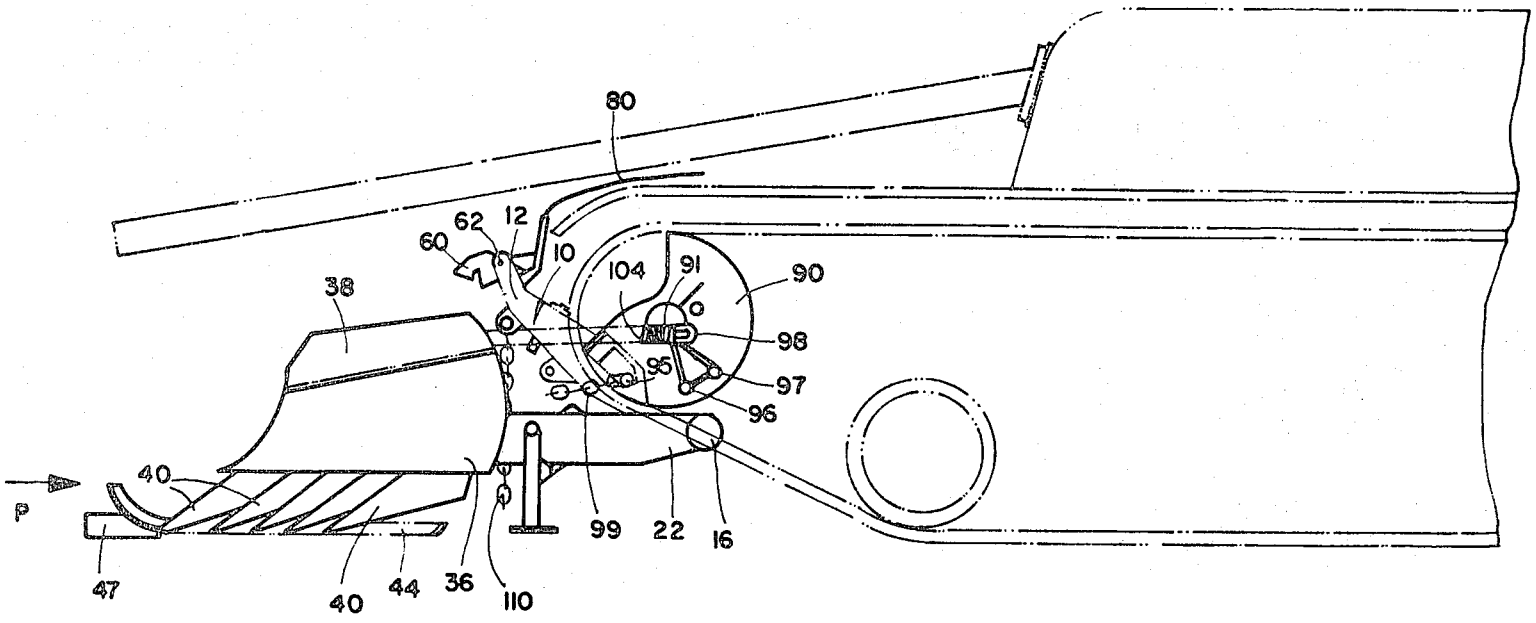
FIG. 2 is a side view illustration of the apparatus of FIG. 1 in a raised orientation.
Figure 3:
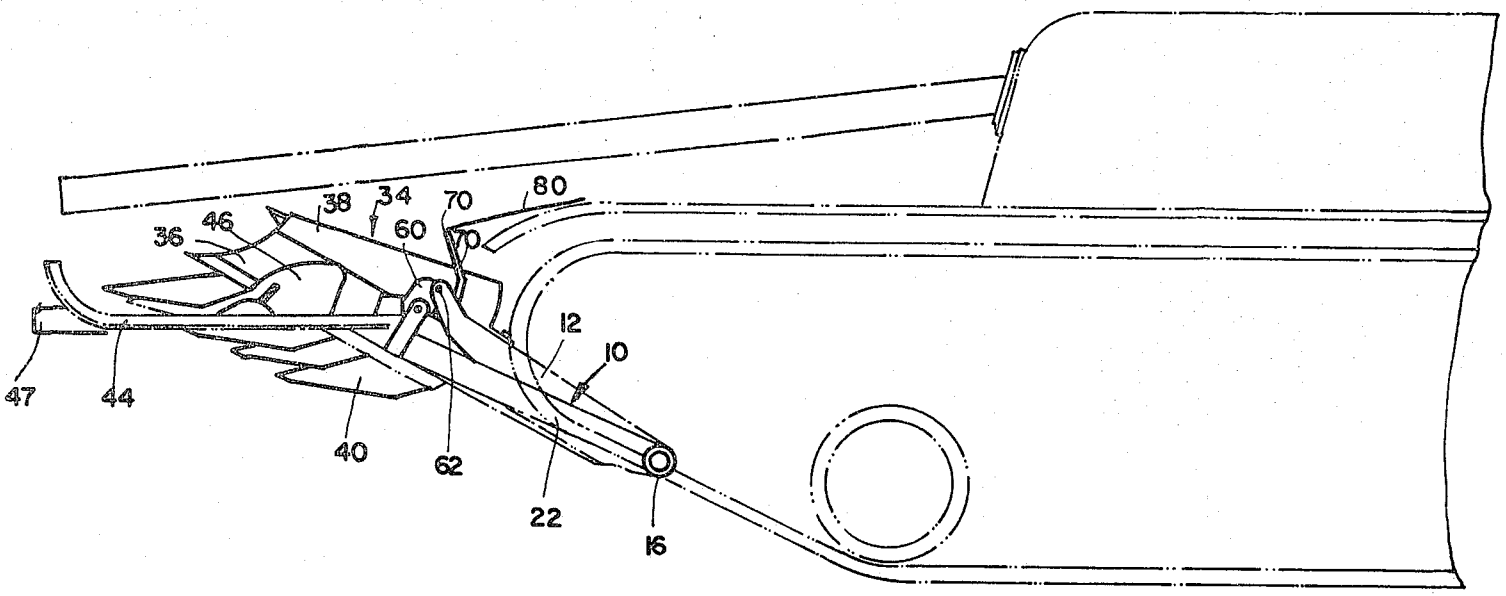
FIG. 3 is a side view illustration of the apparatus of FIGS. 1 and 2 in a partially lowered orientation.

Reference is now made to FIGS. 1–3 which illustrate mine clearing apparatus constructed and operative in accordance with an embodiment of the present invention. The present description is presented with particular reference to mine clearing apparatus which is mountable onto a particular type of tank, the M-60 Patton. It is appreciated that this is entirely for the purpose of illustration and that the invention is applicable to other types of tanks and possibly other vehicles as well.

As seen in the illustrations, the mine clearing apparatus comprises a frame 10 including a pair of identical side portions 12 which are joined at their front end by a cross bar 14 and at their rear end support an axle 16. Frame 10 is rigidly mounted onto an armoured vehicle such as a M-60 tank in the illustrated embodiment by engagement of pins 17 located at side portions 12 with towline lugs fixed onto the tank. Rigidity of mounting is provided by bolts 18 which engage the underside of the tank and force mounting plates 20, fixedly mounted onto side portions 12 on the opposite side of pins 17, into tight engagement with the underside hull of the tank.

First and second arms 22 and 24 are independently rotatably mounted onto axle 16 and extend forwardly thereof in generally parallel planes. Arms 22 and 24 are strengthened by reinforcing elements 26 and 28 respectively which are fixed at one end thereof to the respective arms and are rotatably mounted by means of clamps 30 and 32 onto axle 16.

Rigidly mounted onto each of arms 22 and 24 is a mine plowing assembly 34. Mine plowing assembly 34 comprises main plow portion 36, of generally elongate configuration and concave cross section.

The general configuration of main plow portion 36 may be similar to that of an ordinary vehicle powered snow plow. Disposed above main plow portion 36 and hinged thereonto is an auxiliary plow portion 38. Auxiliary plow portion 38 has two positions, a lowered position in which it it extends forwardly of the surface of main plow portion 36 and a raised position which it defines an upper continuation of the surface of the main plow portion 36. This hinged construction is to obviate the problem of interference with a drivers field of vision or with the range of operation of the armament on a tank. Towards this end, the hinged auxiliary plow portion 38 may be lowered when the plowing assembly 34 is in its raised orientation.

Disposed below main plow portion 36 there are provided a plurality of vertically disposed planar blades 40, which during operation are disposed below the ground surface. The horizontal spacing between adjacent vertical blades is selected to be such that anti-vehicle mines will of necessity be engaged thereby. The blades are provided with an inclined forward surface, so as to raise mines located under the ground surface into engagement with main plow portion 36, so that they may be plowed aside.

A desired depth of operation for blades 40 is determined by means of a gliding surface assembly 42 which is articulatedly mounted onto each of arms 22 and 24. The gliding surface assembly 42 comprises a sled 44 which is arranged to slide on the ground surface and is formed at its front with a vertical blade 46 for deflecting mines to the side thereof. Sled 44 is rotatably mounted onto a cam slot of a mounting plate 46. Mounting plate 46 is mounted in turn onto a mounting element 48. It is appreciated that sled 44 is permitted to undergo a somewhat complex articulated motion in a single plane within limits defined by the respective cam paths. This mounting arrangement permits selectable adjustment of the penetration depth of the plowing assembly 34 and also permits the sled 44 to be folded when the plowing assembly is in its raised orientation to eliminate interference with operation of the tank.

A chain 50 extends from each auxiliary plow portion 38 to a location on the tank hull. The length of the chain 50 is selected such that it is slack when the plowing assembly is in its raised orientation but becomes tight when the plowing assembly is lowered, thus pulling on auxiliary plow portion 38 and orienting it towards a generally vertical orientation. The full raised orientation of the auxiliary plow portion 38 is reached only when soil being plowed is forced thereagainst.

Figure 4A:
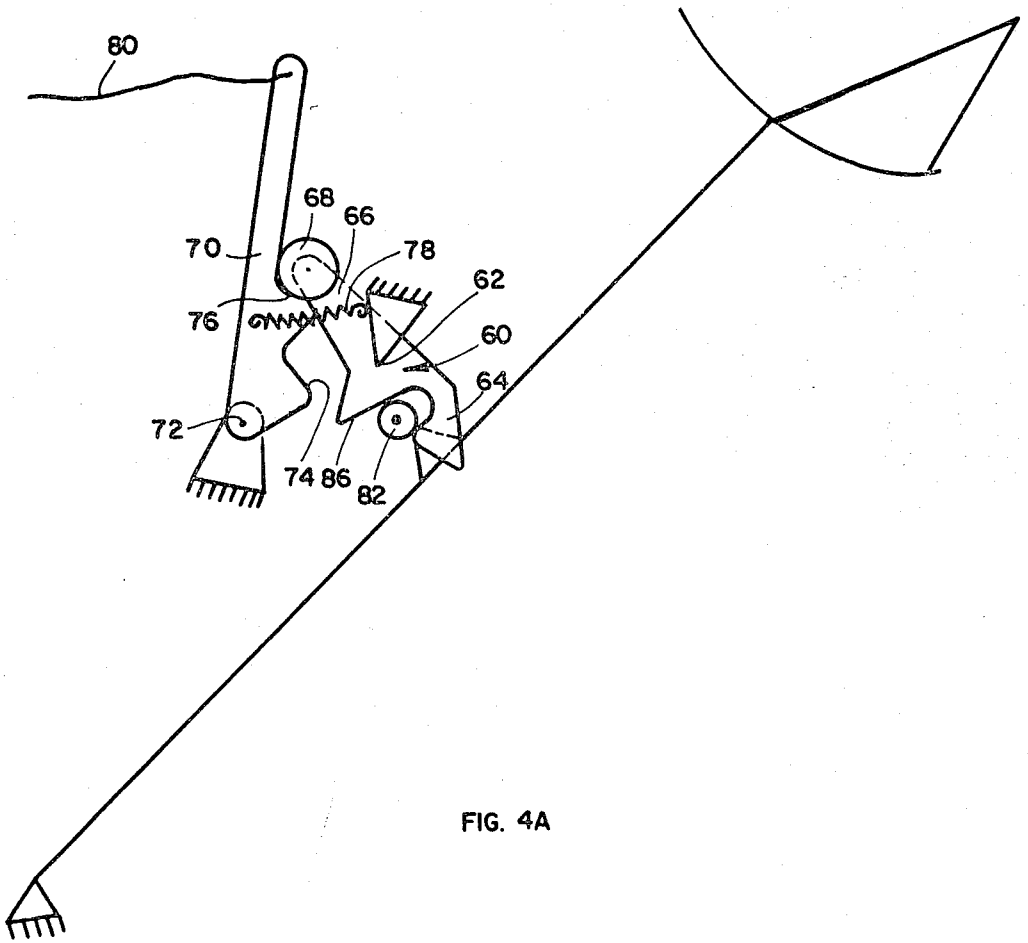
FIGS. 4A and 4B are respective views of a locking mechanism forming part of the apparatus of FIGS. 1, 2 and 3 in respective unlocked and locked orientations.
Figure 4B:
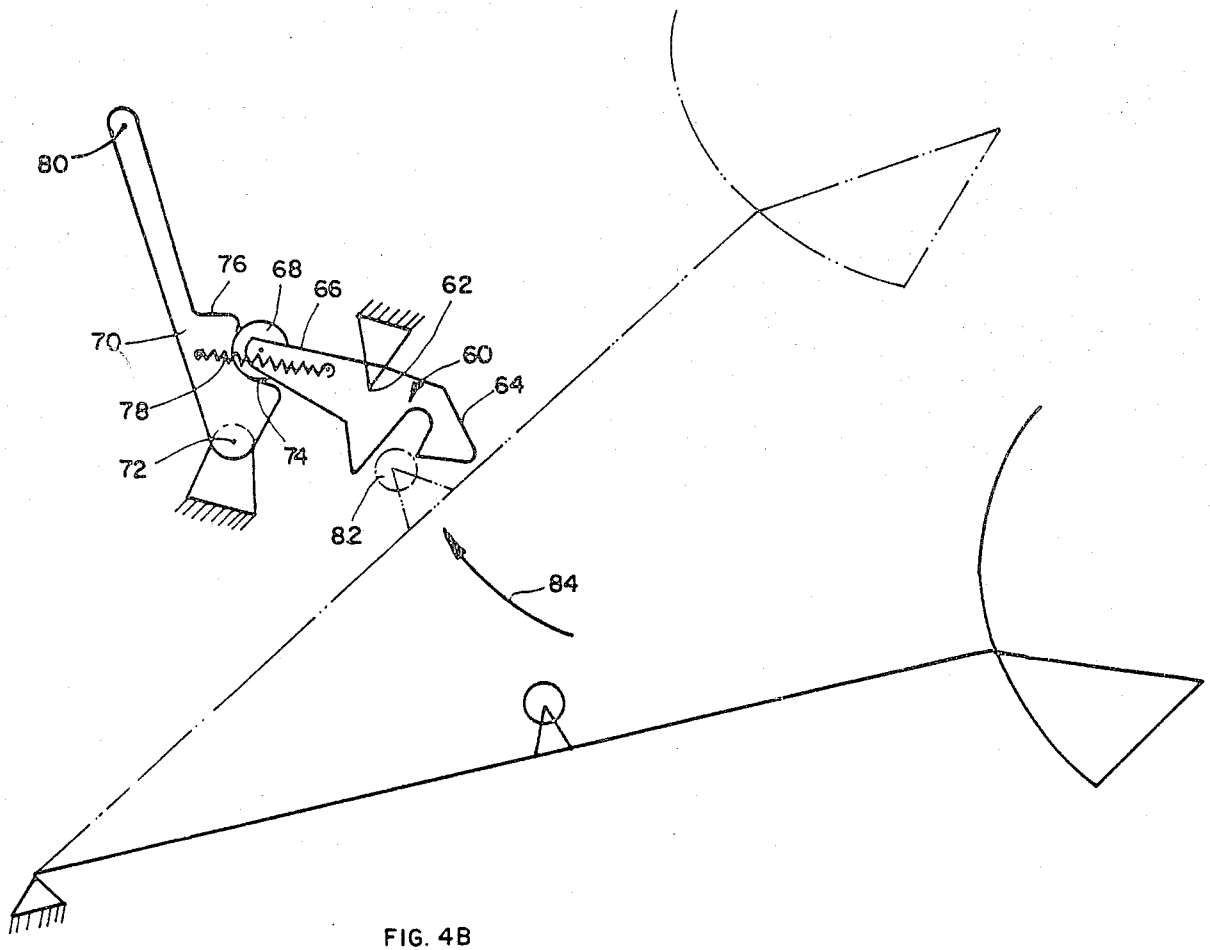

Reference is now made additionally to FIGS. 4A and 4B, which together with FIGS. 1, 2 and 3 illustrate apparatus for retaining the arms in their raised orientation and for selectable release thereof. A hook member 60, is pivotably mounted about an axis 62 onto each side portion 12 and comprises a socket portion 64 located at one end thereof and a roller portion 66 at another end thereof and having mounted thereon a roller 68. A selectable release lever 70 is pivotably mounted onto each side portion 12 about an axis 72 and defines first and second roller support shoulders 74 and 76. A spring 78 joins hook member 60 and release lever 70, urging lever 70 into seating engagement with roller 68 at one of shoulders 74 and 76. A cable connection 80 is provided to the interior of the vehicle, such that pulling on the cable is operative to provide counter-clockwise movement of lever 70 about its pivot axis 72 (as seen in FIGS. 4A and 4B).

The operation of the apparatus described hereinabove will be understood from a consideration of FIGS. 4A and 4B. FIG. 4A shows a retainer roller 82 which is fixedly mounted onto each of arms 22 and 24 about to engage socket portion 64 and moving in an arc illustrated by an arrow 84. Engagement of roller 82 with a surface 86 of the socket portion forces the hook member to pivot in a clockwise direction about its pivot axis 62 (in the sense of FIGS. 4A and 4B). Due to the action of roller 68 against hook member 60, and the subsequent tendency of hook member 60 to rotate in a counterclockwise direction in response to the effect of gravity on roller 82 and the massive plowing assembly attached thereto, roller 68 seats on shoulder 76 and is thus prevented from further counterclockwise rotation into an open orientation. Roller 82 is thus securely engaged by hook member 60 and arms 22 and 24 are maintained in their respective raised orientation, provided that lever 70 remains in the seated position.

When it is desired to lower arms 22 and 24 to their respective lowered, ground engaging orientations, it is sufficient to pull on respective cables 80 from the safety of the driver's compartment. Pulling of cables 80 causes the lever 70 to pivot in a counterclockwise direction and out of supporting engagement with roller 68. Hook member 60 is then free to rotate in a counterclockwise direction about its pivot such that pin 82 is released, thus allowing arm 22 or 24 as the case may be and the associated mine plowing assembly 34 to fall by gravity into their respective lowered orientations in engagement with the ground. Meanwhile, under the influence of spring 78, roller 68 seats on support shoulder 74. It is appreciated that the particular construction of the hook member 60 and of the lever 70 enable the release of the mine plowing assembly to be achieved with relatively little pull force on cable connection 80.

Reference is now made once again to FIGS. 1, 2 and 3 which also illustrate apparatus for automatically lifting the mine plowing assembly. There are provided two installations of such apparatus, corresponding to the two mine plowing assemblies. The apparatus for automatically lifting the mine plowing assembly comprises a freely rotatable disk 90 which is bearing mounted onto a mounting member 92 which is bolted onto a tension wheel 94 of a tank. Tension wheel 94 engages the tread of the tank and maintains it at a desired tension. Mounted on an outer facing surface of disk 90 are three outer pins 95, 96 and 97 and an inner disposed pin 98. Mounted on an inner facing surface of disk 90 is a tooth 100 which is disposed ordinarily out of engagement with corresponding interstices defined between plates of the tank tread.

Mounted on pin 95 is a lifting chain 99 which is attached at its other end to a location 102 fixed onto main plow portion 36. Mounted on pin 98 is a spring 104 which is attached at its other end to main plow portion 36. Spring 104 is operative when in the orientation illustrated in FIG. 2 to urge disk to rotate about its axis 91 in a clockwise direction (in the sense of FIG. 2). This rotation brings tooth 100 into driven engagement with corresponding interstices between plates of the tank tread. As soon as the tank is moving forward, this engagement produces only a clicking action as engagement with the interstices between the plates of the tank tread tend to move the tooth 100 in a counter-clockwise direction, while the spring 104 snaps the tooth back in a clockwise direction.

The apparatus for automatically lifting the mine plowing assembly described above is operative upon reverse motion of the tak with the mine plowing assembly in a lowered orientation. As the tank treads move in a backwards direction tooth 100 engages one of the interstices between adjacent plates thereof and is driven together with disk 90 in a clockwise direction thereby causing chain 99 to wind about pins 96 and 97, with the result that the chain pulls the plowing assembly 34 upwardly until roller 82 engages hook member 60 in locked engagement for retaining the arm and associated plowing assembly in a raised orientation.

Continued backwards motion of the tank tends to continue to drive tooth 100 and disk 90 in clockwise motion. Once plowing assembly 34 is locked by hook member 60, chain 99 cannot move forward in the clockwise direction and thus disk 90 is prevented from progressing in this direction. As a result, tooth 100 repeatedly engages one of the interstices of the tread plates and is pulled forward, only to be snapped back by the action of chain 99. This lifts the tread plate slightly and bangs it down, producing a significant noise which signals to the operator to terminate backwards motion.

Once forwards motion is commenced, tooth 100 engages one of the interstices of the tread places and is moved in a counterclockwise direction until it reaches a location at which the treads tend to disengage therewith. Since the orientation of spring 104 has passed its dead spot due to the raised orientation of plowing assembly 34, spring 104 is operative to urge the tooth 100 and disk 90 to undertake further counterclockwise motion until tooth 100 is totally disengaged from the tank treads. This orientation remains until the plowing assembly is lowered, at which time, spring 104 is again reoriented and urges the disk 90 into the orientation shown in FIG. 2.

A limit chain 110 is provided for attachment between frame 10 and each of arms 22 and 24 to prevent arms 22 and 24 from falling beyond a certain limit in the event that a sudden drop in the ground level is encountered, as such a drop could otherwise bring the plowing assembly into engagement with the tank treads.

It is noted that the plowing assembly engages the ground surface in the vicinity of the treads and outwardly thereof. In order to protect the intermediate portion of the tank from mine damage a weighted chain 120 is mounted between the two plowing assemblies to engage and detonate any mines that are encountered at a safe distance from the tank.

It will be appreciated by persons skilled in the art that the invention is not limited to what has been particularly shown and described hereinabove. The scope of the invention is defined only by the claims which follow:

We claim:

1. Mine clearing apparatus for attachment to a vehicle including a vehicle tread and comprising:

a frame mountable onto a vehicle for selectable positioning in a raised or lowered orientation;

means, mounted onto said frame, for raising and shunting aside mines;

means for selectably retaining said frame in a raised orientation and including control means operable from inside the vehicle for selectably releasing the frame from its raised orientation and allowing it to assume its lowered orientation; and means for automatically raising said frame from its lowered orientation to its raised orientation in response to backwards motion of the vehicle and comprising:

mounting means rotatably mounted onto the vehicle;

supporting means mounted onto said mounting means and attached to said raising means and operative, when actuated, to raise said frame means to its raised orientation;

tooth means fixed onto said mounting means and arranged for selectable engagement with a vehicle tread; and means for urging said tooth means into driven engagement with said vehicle tread whereby during backwards movement of said vehicle, the vehicle tread causes the mounting means to rotate, thereby actuating said supporting means, thereby raising said frame to its raised orientation.

2. Apparatus according to claim 1 and wherein said raising and shunting means comprises:

a plurality of plow teeth which, in operation, extend below the ground surface;

first and second plow sections, disposed one above another in hinged engagement, said first and second plow sections being operative to lie in the same plane during operation and in folded engagement when said frame is in its raised orientation, so as not to interfere with normal vehicle operation.

3. Apparatus according to claim 1 and wherein said raising and shunting means comprises:

a gliding surface which supports said frame in its lowered orientation; and a front mine deflector plate arranged in front of said gliding surface for deflecting mines in the path thereof.

4. Apparatus according to claim 3 and also comprising means for retaining said gliding surface to prevent inadvertent engagement of said gliding surface with threads of the vehicle.

5. Apparatus according to claim 1 and wherein said means for selectably retaining comprises:

a hook member arranged to pivot about a first axis and having a receiving socket at a first end thereof and a roller at a second end thereof;

a releasing lever mounted for rotation about a fixed pivot and defining first and second seating shoulders for said hook member, said first seating shoulder corresponding to a locked orientation of said hook member and said second seating shoulder corresponding to an open orientation of said hook member;

a spring interconnecting said hook member and said releasing lever for urging said roller into seating engagement with a selected one of said first and second seating shoulders in accordance with the pivotal orientation of said releasing lever; and means for selectably adjusting the position of said releasing lever from a protected location inside the vehicle and being operable in response to application of a pulling force thereon to position said hook member in said open orientation for releasing said frame and permitting it to assume its lowered orientation.

6. Apparatus according to claim 1 and wherein said means for urging comprises eccentrically mounted spring means attached to said mounting means and to said frame for orienting said mounting means.

* * * * *

UNITED STATES PATENT AND TRADEMARK OFFICE

CERTIFICATE OF CORRECTION

PATENT NO. : 4,467,694

DATED : August 28, 1984

INVENTOR(S) : Max Azulai et al.

It is certified that error appears in the above-identified patent and that said Letters Patent is hereby corrected as shown below:

Column 2, line 60, should read:

--tion in which it extends forwardly of the surface of--

Column 2, line 64, should read:

--the problem of interference with a driver's field of vision--

Column 3, line 41, should read:

--60 is pivotably mounted about an axis 62 onto each side--

Column 4, line 56, should read:

--reverse motion of the tank with the mine plowing assem- --

Signed and Sealed this

*Eleventh* Day of *March 1986*

[SEAL]

*Attest:*

DONALD J. QUIGG

*Attesting Officer*

*Commissioner of Patents and Trademarks*